US006568945B2

(12) United States Patent
Whybrow

(10) Patent No.: US 6,568,945 B2
(45) **Date of Patent: *May 27, 2003**

(54) ELECTRICAL CONNECTION AND CONNECTORS

(75) Inventor: David Ernest Whybrow, Woodley (GB)

(73) Assignee: Smiths Industries Public Limited Company, London (GB)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/265,828

(22) Filed: Mar. 10, 1999

(65) Prior Publication Data

US 2002/0002005 A1 Jan. 3, 2002

(30) Foreign Application Priority Data

Apr. 17, 1998 (GB) ..... 9808141

(51) Int. Cl.[7] ..... H01R 6/58
(52) U.S. Cl. ..... 439/86; 439/610
(58) Field of Search ..... 439/610, 931, 439/609, 63, 91, 86, 587–589

(56) References Cited

U.S. PATENT DOCUMENTS

| | | | | |
|---|---|---|---|---|
| 4,614,398 A | | 9/1986 | Wright et al. | |
| 4,929,195 A | | 5/1990 | Seidoh | |
| 5,298,194 A | | 3/1994 | Carter et al. | |
| 5,356,298 A | | 10/1994 | Voss et al. | 439/63 |
| 5,741,143 A | * | 4/1998 | Hotea et al. | 439/86 |
| 5,775,948 A | * | 7/1998 | Madeley | 439/610 |

FOREIGN PATENT DOCUMENTS

| | | |
|---|---|---|
| EP | 0 485 991 A1 | 11/1991 |
| GB | 2 181 607 A | 10/1986 |

* cited by examiner

*Primary Examiner*—Gary Paumen
(74) *Attorney, Agent, or Firm*—Connolly Bove Lodge & Hutz LLP

(57) ABSTRACT

A connector backshell contains a wad of wire wool encapsulated in an elastomeric silicone. Screened cables extend through passages through the wad and have their braided screening sleeves exposed within the passages. The wire wool is exposed within the passages and on the outside of the wad so that it electrically connects the screening sleeves with the inside of the backshell.

7 Claims, 1 Drawing Sheet

ELECTRICAL CONNECTION AND CONNECTORS

BACKGROUND OF THE INVENTION

This invention relates to electrical connection and connectors.

The invention is more particularly concerned with connectors for making electrical connection to a screening sleeve of an electrical cable.

Where electrical connection is made to the screening sleeve of an electrical cable, it preferably has a low resistance and the connection is preferably of a kind that can be easily made and removed for servicing. If the screening sleeve is braided, it is preferable that the connection can be made without the need to separate the braid from the signal conductor.

BRIEF SUMMARY OF THE INVENTION

It is an object of the present invention to provide a connector for making connection to a conductive sleeve of a cable.

According to one aspect of the present invention there is provided an electrical connector for making connection to a conductive sleeve of a cable of the kind comprising an inner conductor, an insulating sheath extending around the inner conductor and a conductive sleeve extending around the insulating sheath and exposed at least along a part of its length on the outer surface of the cable, the connector including a housing containing a wad of electrically-conductive filamentary material arranged to make electrical connection with the conductive sleeve and with an electrically-conductive surface in the housing.

The electrically-conductive filamentary material is preferably encapsulated with another material such as a resilient material, for example, elastomeric silicone. The wad may be preformed with a passage for the cable, the filamentary material being exposed in the passage and on an external surface of the wad. The housing is preferably of an electrically-conductive material. The connector may include a shell supporting an electrical contact element connected with the inner conductor, the housing being a backshell screwed onto the shell.

According to another aspect of the present invention there is provided an electrical connector assembly including a connector according to the above one aspect of the invention and a cable extending through the wad of electrically-conductive material.

According to a further aspect of the present invention there is provided an electrical connector assembly comprising a connector and a cable, the cable including an inner conductor, an insulating sheath extending around the inner conductor and a conductive sleeve extending around the insulating sheath and exposed at least along a part of its length on the outer surface of the cable, the connector including a forward shell supporting a contact element, a backshell having an electrically-conductive inner surface, and a wad of electrically-conductive filamentary material located in the backshell, the wad having a passage therethrough, the cable extending through the passage with the conductive sleeve exposed in the passage and the inner conductor projecting beyond the wad and being connected with the contact element, and the filamentary material being exposed in the passage and on the external surface of the wad so that the wad makes electrical connection between the conductive sleeve and the electrically-conductive surface in the backshell.

An electrical connector assembly including a connector according to the present invention, will now be described, by way of example, with reference to the accompanying drawings.

DETAILED DESCRIPTION OF THE PREFERRED EMBODIMENTS

Figure 1:
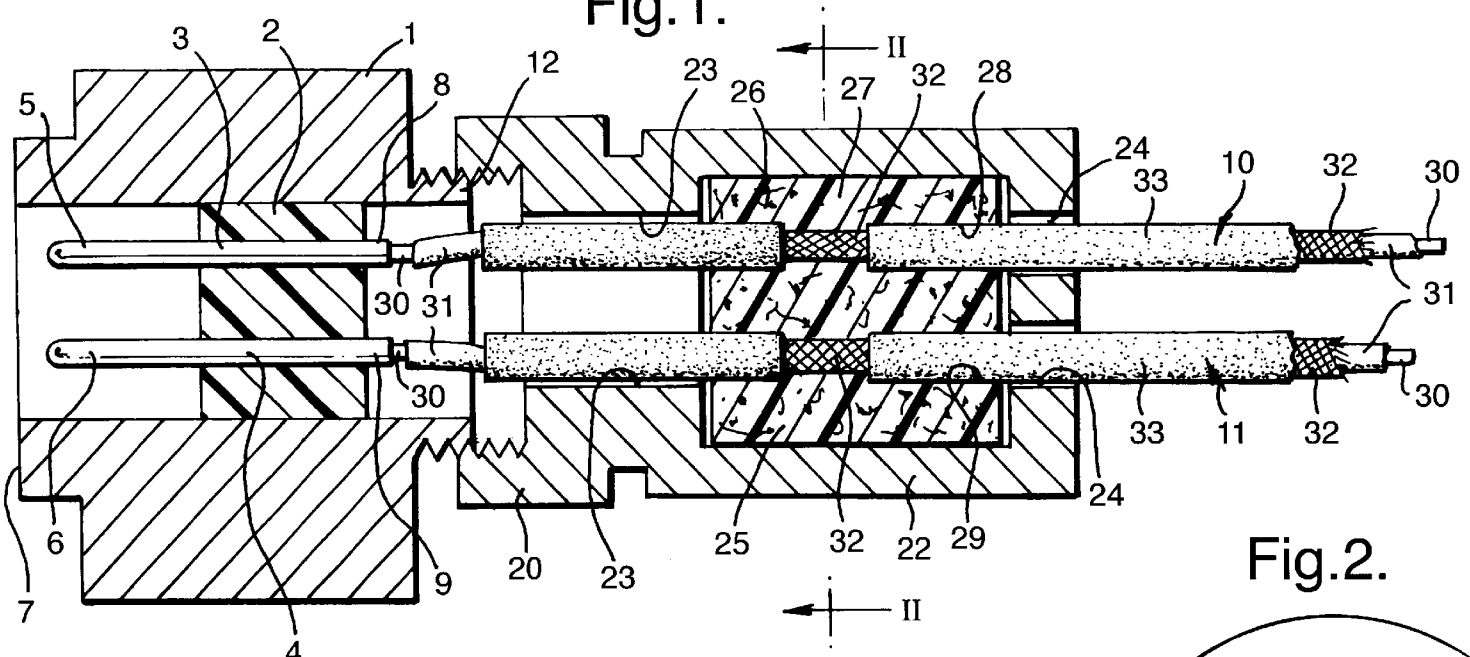
FIG. 1 is a sectional side elevation view of the connector.
Figure 2:
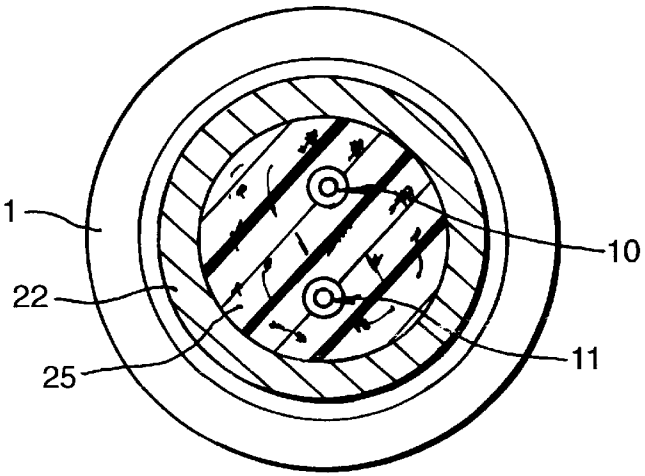
FIG. 2 is a lateral sectional view along the line II—II of FIG. 1.

The connector comprises a main body portion or shell 1 machined from metal, such as brass, and supporting an electrically-insulative body 2, which in turn supports two contact elements 3 and 4. The contact elements 3 and 4 project forwardly of the insulator body 2 where they are formed into male pin elements 5 and 6 located within the forward, open end 7 of the shell 1. The pin elements 5 and 6 are arranged for contact with cooperating female elements in a mating connector (not shown). The rear end 8 and 9 of each contact element 3 and 4 is formed with a crimp or solder recess of conventional form, which is adapted to receive and make electrical connection to the forward end of respective cables 10 and 11.

The rear end of the shell 1 is formed with a reduced diameter, externally-threaded neck portion 12 through which the cables 10 and 11 extend. A metal housing or backshell 20 is screwed on the rear end of the neck portion 12, the forward end 21 of the backshell being internally threaded. The rear end of the backshell 20 forms an enclosed, electrically-conductive housing 22 with apertures 23 and 24 at opposite ends through which the cables 10 and 11 can be threaded. Inside, the rear housing 22 of the backshell contains an electrically-conductive member 25 in the form of a wad 26 of metal filaments, or wire wool, similar to that used for pot scourers, encapsulated in an elastomeric silicone 27. Other materials such as foam or gel could be used for encapsulation. The metal wad 26 is preferably of a metal having a high electrical conductivity, such as copper or beryllium-copper but may be of any suitable electrically-conductive filamentary material or combination of materials. The conductive member 25 is tightly packed into the housing 22 and is preformed with two passages 28 and 29 narrower than the cables 10 and 11. The filaments of the metal wad 26 are exposed on the inside of the passages 28 and 29, and on the external surface of the member 25. The metal wad 26, therefore, electrically contacts the cables 10 and 11 where they extend through the housing 22 and also contacts the inside of the housing 22.

Each cable 10 and 11 comprises a central wire conductor 30 having an insulating sheath 31 extending coaxially of the wire. A braided wire sleeve 32 provides a conductive screening sleeve around the insulating sheath 31 and wire 30. On its outside, each cable 10 and 11 has a protective insulating jacket 33. At the forward end of the cables 10 and 11, the jacket 33, screening sleeve 31 and insulating sheath 31 are stripped off to expose the wire 30, so that this can be connected to the rear ends 8 and 9 of the contact elements 3 and 4. The cable outer jacket 33 is also removed from a short region 34 of the cables 10 and 11 at a location along the cables that will be situated within the rear housing 22 of the backshell 20, so that the screening sleeve 32 is exposed on each cable within the passages 28 and 29 through the wad 26. In this way, the screening sleeves 32 are contacted by the conductive member 25 and an electrical path is established between the screening sleeves and the backshell 22 via the conductive member. This ensures effective electrical connection between the screening sleeves 32 and the shell 2 of the connector so that the screening path can be continued to the mating connector or to a ground plane.

The cables 10 and 11 are preferably assembled in the connector housing 22 while the conductive member 25 is outside the backshell and in an expanded state. A spike is used to thread the cables through the conductive member and a funnel is used to compress the conductive member into the housing 22.

The present invention provides easy and effective connection to the screening sleeve of a cable in a manner that enables ready disconnection for repair or replacement. Also, there is no need to separate the screening sleeve from the cable, making preparation of the cable very simple. The invention can be used with cables of different profiles and diameters. The connector allows the maximum space to be available for the cables and is of low weight. The connector can be reused after removal of the cables, if necessary, replacing the conductive member.

The resilient nature of the conductive member 25 may be sufficient by itself to ensure effective connection between the cable screens 32 and the inside of the backshell 22. In some arrangements, however, it might be preferable to have some additional means to improve the contact. This, for example, could take the form of a separate spring element inside the backshell. Alternatively, the backshell could be formed in separate parts the separation of which can be altered, such as by screwing together, to reduce the internal volume and compress the member 25 more tightly against the screening sleeves 32 and the inside of the backshell 22. Strain relief devices could be used to retain the cables 10 and 11 where they emerge at the left-hand end of the backshell 22. The strain relief device could be a plastic cap with an aperture shaped to grip the cables. The backshell itself need not be conductive, instead it could have a conductive surface, such as provided by an insert in the housing. It will be appreciated that the invention could be used with any number of cables and that the cables could have more than one wire. The connector need not make mating connection with another connector but could be mounted on a bulkhead or the wall of a housing.

What I claim is:

1. An electrical connector for making connection to a conductive sleeve of a cable, said cable comprising an inner conductor, an insulating sheath extending around the inner conductor and a conductive sleeve extending around the insulating sheath and exposed at least along a part of its length on an outer surface of the cable, wherein the connector comprises: a housing, said housing having an electrically-conductive surface; and a wad of electrically-conductive filamentary material located in said housing, said wad being encapsulated in a resilient material so the said wad expands between said housing and conductive sleeve to make electrical connection with said conductive sleeve and with said electrically-conductive surface in said housing.

2. An electrical connector according to claim 3, wherein said resilient material is an elastomeric silicone.

3. An electrical connector according to claim 1, wherein said wad is preformed with a passage for said cable, and wherein said filamentary material is exposed in said passage and on an external surface of said wad.

4. An electrical connector according to claim 1, wherein said housing is of an electrically-conductive material.

5. An electrical connector according to claim 1, wherein said connector includes a shell, an electrical contact element connected with said inner conductor, and an insert supporting said contact element in said shell, and wherein said housing is a backshell screwed onto said shell.

6. An electrical connector for making connection to a conductive sleeve of a cable, said cable comprising an inner conductor, an insulating sheath extending around the inner conductor and a conductive sleeve extending around the insulating sheath and exposed at least along a part of its length on the outer surface of the cable, wherein the connector comprises: a forward shell, said shell including an insert and a contact element supported by said insert; and a backshell having an electrically-conductive inner surface, wherein said backshell includes a compressible wad of electrically-conductive filamentary resilient material located in said backshell which expands between said backshell and said conductive sleeve, said wad having a passage extending therethrough for said cable, wherein said filamentary material is exposed in said passage and on an external surface of said wad so that said wad makes electrical connection between said conductive sleeve and said electrically-conductive surface in said backshell.

7. An electrical connector assembly comprising a connector and a cable, said cable comprising an inner conductor, an insulating sheath extending around the inner conductor and a conductive sleeve extending around the insulating sheath and exposed at least along a part of its length on the outer surface of the cable, wherein the connector comprises: a forward shell, said shell including an insert and a contact element supported by said insert; and a backshell having an electrically-conductive inner surface, wherein said backshell includes a compressible wad of electrically-conductive filamentary resilient material located in said backshell expands between said backshell and said conductive sleeve, said wad having a passage extending therethrough, wherein said cable extends through said passage with said conductive sleeve exposed in said passage and said inner conductor projects beyond said wad and is connected with said contact element, and wherein said filamentary material is exposed in said passage and on an external surface of said wad so that said wad makes electrical connection between said conductive sleeve and said electrically-conductive surface in said backshell.

* * * * *